United States Patent [19]

Pounds

[11] 3,958,736

[45] May 25, 1976

[54] WEB TENSIONING AND STEERING

[75] Inventor: Robert M. Pounds, Bogalusa, La.

[73] Assignee: Crown Zellerbach Corporation, San Francisco, Calif.

[22] Filed: Nov. 6, 1974

[21] Appl. No.: 521,506

[52] U.S. Cl. ..... 226/3; 226/21; 226/196

[51] Int. Cl.[2] ..... B65H 23/02; B65H 25/26

[58] Field of Search ..... 226/3, 15, 16, 18, 19–23, 226/199, 196

[56] References Cited

UNITED STATES PATENTS

| | | | |
|---|---|---|---|
| 3,254,818 | 6/1966 | Jacobsen | 226/19 X |
| 3,380,637 | 4/1968 | Knapp | 226/21 X |
| 3,436,002 | 4/1969 | Racine | 226/23 |
| 3,554,423 | 1/1971 | Alexoff | 226/19 |

*Primary Examiner*—Allen N. Knowles

[57] ABSTRACT

Simultaneously tensioning one side of a web and correcting steering error introduced by said tensioning comprising passing the web partially around a tensioning member, e.g. a roll, and skewing the roll axis relative to a neutral axis, with the end of the roll adjacent the side of the web to be tensioned positioned, relative to the other end of the roll, toward the portion of the web wrapped around the roll and forward in the direction of web movement.

13 Claims, 5 Drawing Figures

WEB TENSIONING AND STEERING

This invention relates to web tensioning and steering. In particular this invention relates to a method for removing slack from one side of a web.

It is a principal object of this invention to provide a method for simultaneously tensioning one side of a web while correcting steering error introduced by the tensioning. It is a further object of this invention to provide a method for removing slack from one side of a web without causing the web to depart from a predetermined path.

In general this invention features wrapping the web partially around the surface of a tensioning member and moving the web past the tensioning member. The tensioning member is positioned with its axis skewed relative to a netural axis in which equal tension would be applied across a perfect web, with one end of the tensioning member, at the side of the web to be tensioned, positioned, relative to the other end, toward the portion of the web wrapped around the tensioning member surface and forward in the direction of movement of the web.

In preferred embodiments the tensioning member comprises a rotating cylindrical roll, the web is wrapped 90° about the circumference of the roll and the roll axis is moveable to said skewed position from a position coincident with the neutral axis. The ends of the roll are respectively moved equal distances along a first line extending through the neutral axis and intersecting, bisecting, the portion of the web wrapped around the tensioning member surface and along a second line extending through the neutral axis and extending, at a right angle to the first line, generally along the path of movement of the web.

Figure 1:
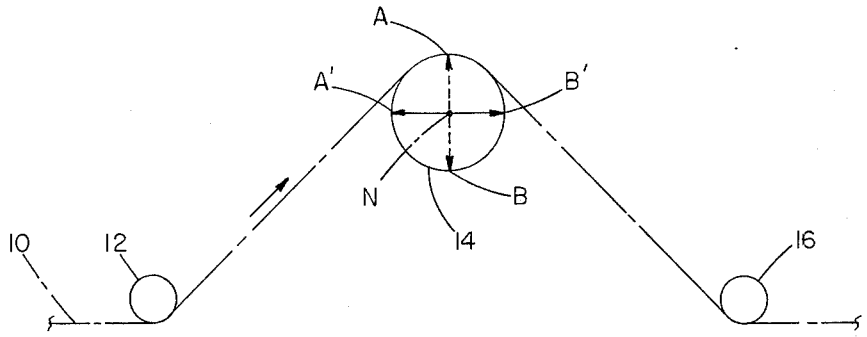
Figures 2A, 2B, 2C:
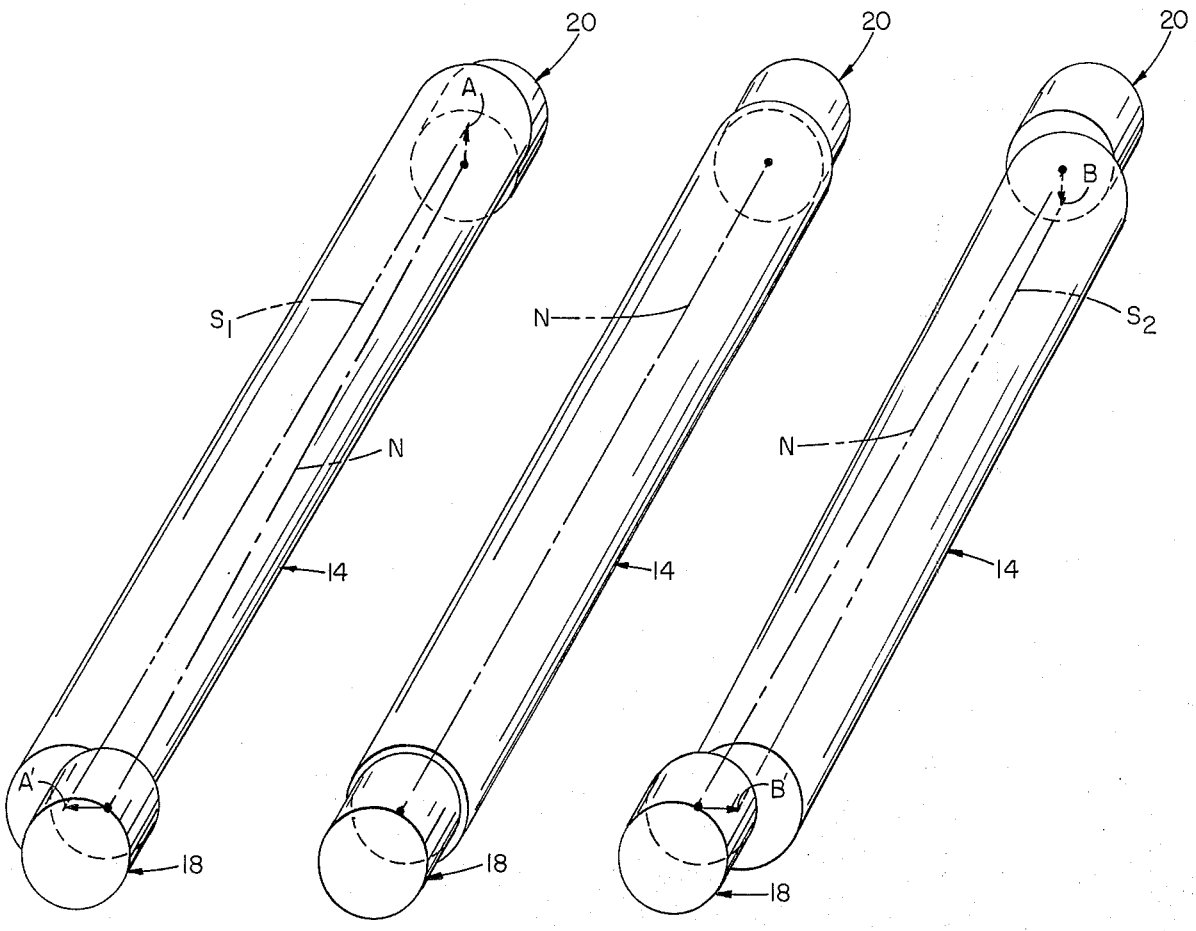
Figure 3:
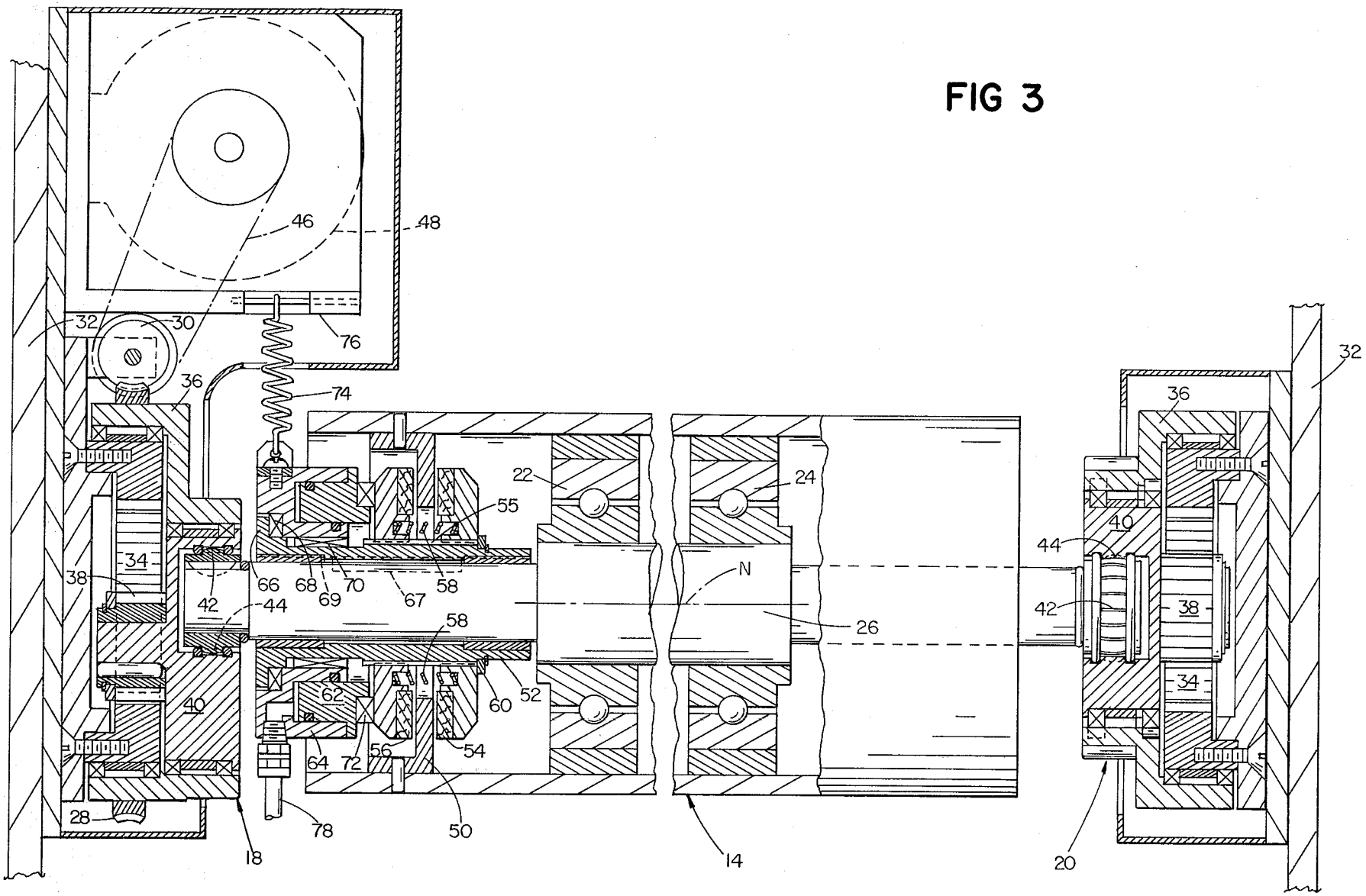

Other objects, features and advantages of this invention will be apparent to those skilled in the art from the following detailed description of a preferred embodiment thereof, taken together with the accompanying drawings, in which:

FIG. 1 is a diagrammatic end view of a web tensioning system for performing the method comprising the present invention;

FIGS. 2*a*, 2*b* and 2*c* are diagrammatic isometric views of rolls and adjustment members used in the method; and FIG. 3 is an enlarged sectional view of apparatus used in the method.

With reference to FIG. 1 of the drawings, a web 10 extends about a cylindrical idler roll 12, then upwardly at a 45° angle to tensioning member 14, around 90° of the surface of member 14, and down at a 45° angle to another cylindrical idler roll 16. Roll 14 is preferably spaced from each of rolls 12, 16 a distance of 0.5 to 1.0 times the width of web 10. As indicated by arrows in FIG. 1, the direction of movement of the web is generally from idler 12 to idler 16. Tensioning member 14 also comprises a cylindrical idler roll rotating freely in the direction of web movement. The axis of tensioning roll 14, as illustrated in FIG. 1, is initially coincident with a neutral axis N, parallel to the axes of rolls 12, 16, to apply equal tension across web 10 if web 10 were a perfect web, i.e., of uniform dimensional and stress/-strain characteristics.

As illustrated in FIG. 2*b*, tensioning roll 14 is supported between adjustment units 18, 20 with the roll axis coincident with neutral axis N, FIG. 2*b* corresponding to the roll position illustrated in FIG. 1. To tension one side of web 10 and to compensate for steering error introduced by the tensioning, the adjustment units 18 and 20 are simultaneously actuated, moving the tensioning roll ends at right angles to each other along lines AB and A'B' extending through the neutral axis N, shown in FIG. 1, to position the roll axis in a skewed position relative to the neutral axis N. The remote end of roll 14 is moved along the line AB and the near end is moved along the line A'B', in the embodiment shown in FIG. 1, line AB bisecting the segment of the surface of roll 14 about which web 10 is wrapped and line A'B' extending generally in the direction of movement of the web 10.

It is the remote side of web 10 which is to be tensioned, the far end of roll 14 is moved toward the web 10, i.e., in the direction A, and the near end of the roll 14 is simultaneously moved rearwardly an equal distance, i.e., in the direction A'. The resultant position of roll 14 with its axis in position $S_1$, skewed relative to neutral axis N, is illustrated in FIG. 2*a*. If, on the other hand, it is the near side of web 10 which is to be tensioned, the far end of roll 14 is moved away from web 10, i.e., in the direction B, and the near end of the roll 14 is simultaneously moved forwardly an equal distance, i.e., in the direction B'. The resultant position of roll 14 with its axis in position $S_2$, skewed relative to neutral axis N, is illustrated in FIG. 2*c*.

In each instance the roll ends are adjusted such that the end adjacent the side of web 10 to be tensioned is positioned, relative to the other roll end, toward the portion of the web wrapped around the roll 14 and forward in the direction of movement of the web in its predetermined path. The positioning of the end of the roll, adjacent the side of the web to be tensioned, relatively toward the web tensions the web at that side but tends, as well, to steer the web toward that side. Moving that end of the roll relatively forward also in the direction of web movement provides a compensating steering effect maintaining the web in its predetermined path. Thus, the method may be employed with particular advantage to remove a slack edge on one side of a web while maintaining the web motion in its predetermined path.

In FIG. 3 is illustrated apparatus utilized in the performance of the foregoing method. Roll 14, shown aligned with neutral axis N, is rotatably supported by bearings 22, 24 on shaft 26. The ends of shaft 26 are respectively supported by adjustment units 18, 20. Adjustment units 18, 20 are identical except that unit 18 has a worm gear 28 thereon in driving engagement with worm 30.

In general, each adjustment unit includes an internal gear 34 which is nonrotatably mounted relative to a supporting frame 32. A carrier 36 is rotatably supported on the periphery of and coaxially of internal gear 34, the axes of carrier 36 and gear 34 coincident with neutral axis N.

A pinion gear 38, having a diameter and a number of gear teeth one-half that of internal gear 34, is engaged with internal gear 34. Pinion gears 38 of adjustment units 18, 20 are positioned 90° out of phase. A mounting member 40, having its axis coincident with that of pinion 38, is eccentrically and rotatably mounted in carrier 36, pinion 38 supported nonrotatably by mounting member 40. Shaft 26 is also supported nonrotatably and eccentrically in mounting member 40 with the shaft axis positioned on the pitch diameter on pinion 38. Thus the shaft 26 and carrier 34 axes are equidistantly spaced from the axis of pinion 38. A flexible coupling is provided to connect shaft 26 to mounting member 40; in the illustrated embodiment a ball spline 42 is mounted on the end of shaft 26 engaging a spline 44 formed in a cavity in mounting member 40.

The relationship and operation of the various elements of the adjustment units 18, 20 is explained and shown in greater detail in U.S. Pat. No. 3,399,582, issued Sept. 3, 1968, incorporated by reference herein. In particular, a similar out of phase relationship of the pinion gears is illustrated in FIGS. 11*a* and 11*b* of U.S. Pat. No. 3,399,582. By way of explanation of the embodiment illustrated in FIG. 3, pinion 38 of unit 18 is positioned at its lowermost position with shaft 26 on axis N while pinion 38 of unit 20 is positioned midway between its lowermost and uppermost positions and rearwardly of the plane on which the section is taken with the shaft on axis N. Thus as pinion 38 of unit 20 is rotated upwardly moving one end of shaft 26 vertically upwardly as well, pinion 38 of unit 18 and the other end of shaft 26 are simultaneously moved rearwardly relative to the plane of the section, as shown in FIG. 2*a*. Motion in the opposite direction will cause shaft adjustment as shown in FIG. 2*c*.

Preferably worm 30 is connected by a timing belt 46 to a reversible motor 48. A control switch (not shown) connected to motor 48 is used to control motor 48 and hence adjustment units 18, 20. An auxiliary handle (not shown) for manual operation is preferably also connected to worm 30.

A brake assembly is mounted on shaft 26 and roll 14. An annular brake rotor disc 50 is fixedly mounted to the interior of roll 14. A brake mounting 52 is mounted on shaft 26. On the interior side of rotor disc 50, a first annular braking member 54 is slidably mounted on a spline 55 on brake mounting 52. A second braking member 56 is mounted on the exterior side or rotor disc 50. Compression springs 58 normally maintain braking members 54, 56 spaced apart. A washer 60 limits axial movement of braking member 54 relative to brake mounting 52. A brake piston 62 in cylinder 64 bears against braking member 56, axial movement of cylinder 64 limited by flange 66 of brake mounting 52. Key 67 in an elongated slot 69 prevents rotation of mounting 52 and members 54, 56 relative to shaft 26 while permitting axial adjustment along shaft 26. Bearings 68, 70, 72 permit rotation of cylinder 64 and piston 62 relative to the rest of the brake assembly. A spring 74 connected between cylinder 64 and motor mounting 76 maintains the cylinder 64 and piston 62 in a predetermined rotative position. An air supply hose 78 is connected to cylinder 64.

In operation, actuation of the motor rotates the adjustment units 18, 20 causing horizontal linear motion of the shaft end at unit 18 and vertical linear motion of the shaft end at unit 20. The combination of motions, simultaneously, skews the axis of shaft 24 and roll 14 to tension and compensate the steering of a web passing around roll 14. As the roll 14 is skewed it may be necessary or desirable to momentarily brake the roll 14 to remove any wrinkles in the web developing during the skewing due to local stress concentrations. To brake the roll air is introduced into cylinder 64 forcing piston 62 against braking member 56 which in turn engages disc 50; the reaction force causes the assembly to slide on shaft 26 forcing braking member 54 against the other side of disc 50.

Other embodiments of this invention will occur to those skilled in the art which are within the scope of the following claims.

What is claimed is:

1. The method of tensioning one side of a web as it is moved in a predetermined path and simultaneously correcting steering error caused by said tensioning tending to direct said web transversely away from said path, comprising the steps of:

wrapping said web partially around the surface of a tensioning member extending along an axis positioned generally transversely of said web and said predetermined path thereof;

positioning said axis of said tensioning member in a skewed position relative to a neutral axis in which said tensioning member would apply equal tension across a perfect web, with one end of said tensioning member, at the side of said web to be tensioned, positioned, relative to the other end of said tensioning member, a first distance toward the portion of said web wrapped around said tensioning member surface and forward a second distance equal to said first distance in the direction of movement of said web in said predetermined path; and moving said web past said tensioning member in said predetermined path.

2. The method claimed in claim 1 in which said tensioning member comprises a cylindrical roll and said roll rotates about said tensioning member axis in the direction of movement of said web in said predetermined path.

3. The method claimed in claim 2 in which said roll is moveable from a position with its axis coincident with said neutral axis to a said skewed position further including the step of moving said roll while said web is moving past said tensioning member to position said axis of said roll in a said skewed position.

4. The method claimed in claim 3 further including the steps of simultaneously moving said ends of said roll respectively along a first line extending through said neutral axis and intersecting the portion of said web wrapped around said tensioning member surface and along a second line extending through said neutral axis and extending generally in the direction of movement of said web in said predetermined path.

5. The method claimed in claim 4 in which said first and second lines are at right angles to each other.

6. The method claimed in claim 5 in which said first line bisects the segment of said roll surface around which said web is wrapped.

7. The method claimed in claim 6 in which said web is wrapped about a 90° segment of the surface of said roll.

8. The method claimed in claim 5 in which said one end is moved along said first line in a direction toward said web and said other end is moved along said second line in a direction opposite the direction of movement of said web in said predetermined path.

9. The method claimed in claim 5 in which said other end is moved along said first line in a direction away from said web and said one end is moved along said second line in the direction of movement of said web in said predetermined path.

10. The method claimed in claim 8 in which said first line bisects the segment of said roll surface around which said web is wrapped.

11. The method claimed in claim 10 in which said web is wrapped about a 90° segment of the surface of said roll.

12. The method claimed in claim 9 in which said first line bisects the segment of said roll surface around which said web is wrapped.

13. The method claimed in claim 12 in which said web is wrapped about a 90° segment of the surface of said roll.

* * * * *